United States Patent [19]

Csaszar

[11] Patent Number: 4,660,744

[45] Date of Patent: Apr. 28, 1987

[54] NON-REFILLABLE FITMENT

[75] Inventor: Ernest J. Csaszar, Mountainside, N.J.

[73] Assignee: General Kap (P.R.) Corp., P.R.

[21] Appl. No.: 750,031

[22] Filed: Jun. 28, 1985

[51] Int. Cl.[4] ..... B65D 47/02; B65D 49/02

[52] U.S. Cl. ..... 222/147; 222/500; 215/21; 137/516.21

[58] Field of Search ..... 215/2, 21; 137/516.15, 137/516.17, 516.19, 516.21, 516.23; 251/333; 222/147, 478–479, 481, 500, 545, 547, 564, 566–567; 220/319

[56] References Cited

U.S. PATENT DOCUMENTS

| | | | |
|---|---|---|---|
| 281,611 | 7/1883 | Burnett | 222/147 |
| 654,266 | 7/1900 | Mason | 215/21 |
| 773,294 | 10/1904 | Medley | 215/21 |
| 871,276 | 11/1907 | Jameson | 215/21 |
| 1,015,635 | 1/1912 | Rausseau | 215/2 X |
| 1,379,173 | 5/1921 | DeCrow | 137/516.21 |
| 2,307,325 | 1/1943 | Lee | 215/21 |
| 2,326,340 | 8/1943 | Dummer | 215/21 |
| 3,594,824 | 7/1971 | Nakib | 137/516.19 X |
| 3,810,558 | 5/1974 | Crisp et al. | 215/21 |
| 4,261,484 | 4/1981 | Da Costa et al. | 222/500 |
| 4,497,415 | 2/1985 | Delonghi | 215/21 |

FOREIGN PATENT DOCUMENTS

| | | | |
|---|---|---|---|
| 610302 | 10/1960 | Italy | 215/21 |

*Primary Examiner*—Joseph J. Rolla
*Assistant Examiner*—Michael S. Huppert
*Attorney, Agent, or Firm*—Lerner, David, Littenberg, Krumholz & Mentlik

[57] ABSTRACT

A non-refillable fitment is provided in accordance with the teachings of the present invention. The non-refillable fitment takes the form of a hollow cylindrical housing having a valve seat disposed in a lower portion thereof. A valve in the form of an annular ring is provided within the housing and a vented retainer is inserted in an upper portion of the housing. The cylindrical housing may be inserted within the neck of a conventional bottle in much the same manner as a cork and when so inserted and the bottle is vertically disposed, the inner circumferential surface of said valve will seal against the valve seat and the outer circumferential surface of the valve will seal against an inner circumferential surface of the hollow cylindrical housing to prevent refilling. When the bottle is inclined to a pouring angle, the valve will be cocked against the retainer to permit pouring to take place.

8 Claims, 3 Drawing Figures

NON-REFILLABLE FITMENT

BACKGROUND OF THE INVENTION

This invention relates to non-refillable fitments, and more particularly to a pouring fitment assembly for rendering bottles containing pourable consumables or the like non-refillable.

Bottlers of quality consumables are plagued by the unauthorized refilling of bottles in which their product is sold by the unscrupulous. In the liquor industry, for instance, refilling of bottles originally containing high quality premium goods with either lower quality or adulterated mixtures, or even a dilution of the original goods, is notorious. Furthermore, recent events have led all manufacturers of consumables to seek ways to render products tamper-proof. In areas such as the liquor industry where product is frequently dispensed from opened containers, such a need is especially great because here a broken seal on the container will not provide an indication that tampering may have occurred. Thus for many reasons, an open bottle of an alcoholic beverage which stands, for example, on a bar shelf or the like should be tamper-proof to provide protection to the public, the owner of the establishment and the original bottler of the goods.

While the need for devices to achieve this function has long been recognized and recently has become acute, the many attempts to provide devices of this type have not generally met with great success. Thus, while a rather substantial body of prior art directed to non-refillable bottles and non-refillable bottle closures exists, the actual number of these devices which one finds in use on products in the marketplace is very slight.

The principal reasons that non-refillable bottles and/or non-refillable closures therefor have not widely proliferated in the marketplace are that most, if not all, of the devices which are available are either not effective or impose untoward expense upon those seeking to render their product safe, secure and tamper-proof. More particularly, while many of the designs of non-refillable bottles and closures available in the patent literature are quite capable of frustrating casual attempts at refilling or adulterating the contents of a bottle, such devices fail to either stop or provide plain indicia of tampering against those willing to take painstaking effort to achieve their purpose. Thus frequently, non-refillable bottles or bottles rendered non-refillable through the use of accessory valves or caps can readily be compromised by a pin inserted through the top of the container and used to hold open the valve. Additionally, shaking or tilting the bottle while the same is filled will frequently overcome known valving systems, enabling the same to be readily compromised.

To enhance the difficulty, known prior art devices are not only relatively expensive in their own right but typically cannot be employed with standard bottles and caps. Instead, such prior art devices require either specially blown bottles or bottles having specially configured or finished neck portions to accommodate the valving mechanism. When these disadvantages are not present, the housing or the like employed for the valving mechanism typically requires mounting on the neck portion of the bottle as an extension thereof, rendering the resulting product unsightly and maintaining the valving mechanism at an exposed location where the same is readily available for purposes of tampering or the like. Additionally, the many cooperating parts typically employed in prior art non-refillable bottles or closures render them subject to clogging and sticking. As a result, such devices are rendered either self-defeating from the standpoint of being refilled or a liability to the manufacturer when the contents become unavailable to the user.

U.S. Pat. No. 4,497,415 as issued to Delonghi on Feb. 5, 1985, and U.S. Pat. No. 3,810,558 as issued to Crisp et al. on May 14, 1974 exemplify non-refillable fitments available in the prior art which result in an extension to the neck of the bottle. U.S. Pat. No. 2,326,340 as issued to S. R. Dummer on Aug. 10, 1943, U.S. Pat. No. 2,307,325 as issued to O. H. Lee on Jan. 5, 1943, U.S. Pat. No. 1,015,635 as issued to C. E. Rausseau on Jan. 23, 1912, U.S. Pat. No. 773,294 as issued to C. Medley on Oct. 25, 1904, and U.S. Pat. No. 654,266 as issued to H. B. Mason on July 24, 1900 exemplify non-refillable bottles or fitments therefor which require a specialized bottle.

Therefore, it is a principal object of the present invention to provide non-refillable fitments which may be employed with standard bottles and caps and used therewith in much the same manner as a conventional cork.

A further object of this invention is to provide non-refillable fitments which are simple and inexpensive to manufacture.

Another object of the present invention is to provide non-refillable fitments which may be readily incorporated and installed in a standard bottling line.

An additional object of the present invention is to provide non-refillable fitments employing a self-centering valve in the form of an annular ring exhibiting inner and outer circumferentially disposed sealing surfaces.

Another object of the present invention is to provide a non-refillable vented fitment wherein the venting structure is displaced in order to deny ready access to a valve and valve seat.

Various other objects and advantages of the present invention will become clear from the following detailed description of an exemplary embodiment thereof and the novel features will be particularly pointed out in conjunction with the claims appended hereto.

SUMMARY OF THE INVENTION

In accordance with the teachings of the present invention, a non-refillable fitment is provided in the form of a hollow cylindrical housing having a valve seat disposed in a lower portion thereof, a valve in the form of an annular ring is provided within said housing and a vented retainer is inserted in an upper portion of said housing; said cylindrical housing may be inserted within the neck of a conventional bottle in much the same manner as a cork, and when so inserted and the bottle is vertically disposed, the inner circumferential surface of said valve will seal against said valve seat and the outer circumferential surface of said valve will seal against an inner circumferential surface of said hollow cylindrical housing to prevent refilling, while when said bottle is inclined to a pouring angle said valve will be cocked against said retainer to permit pouring to take place.

BRIEF DESCRIPTION OF THE DRAWINGS

The invention will be more clearly understood by reference to the following detailed description of an exemplary embodiment thereof in conjunction with the accompanying drawings in which.

DETAILED DESCRIPTION

Figure 1:
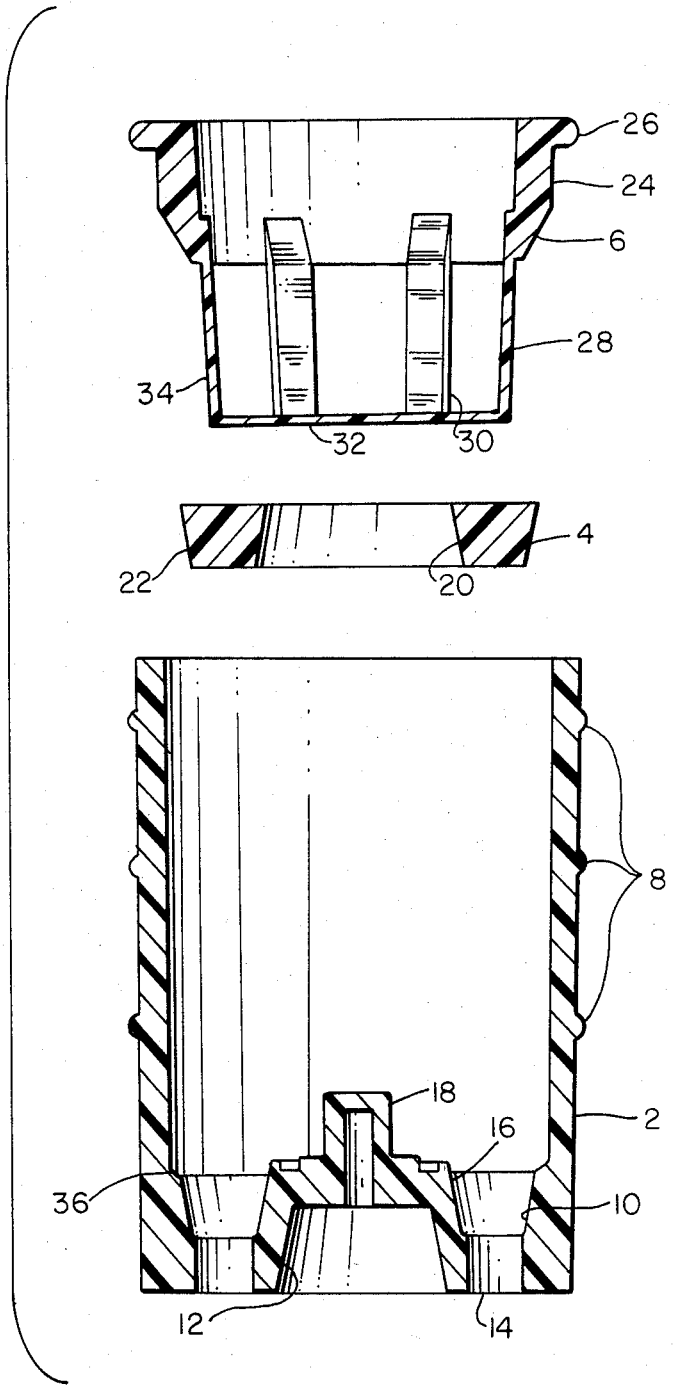
FIG. 1 is a sectional, exploded view of an exemplary embodiment of a non-refillable fitment in accordance with the teachings of the present invention.

Referring now to FIG. 1, there is shown an exploded view, in section, of an exemplary embodiment of a non-refillable fitment in accordance with the teachings of the present invention. The exemplary embodiment of the non-refillable fitment illustrated in FIG. 1 comprises a hollow cylindrical housing 2, a valve in the form of an annular ring 4 and a vented retainer 6. Those of ordinary skill in the art will appreciate that the exemplary embodiment of the invention illustrated in FIG. 1 thus comprises essentially only three pieces, each of which is readily moldable using conventional injection techniques or the like. The hollow cylindrical housing 2 may have a height of approximately one inch and a diameter slightly smaller than a selected one of the inner diameters of the several industry standards employed for liquor bottles or the like.

The hollow cylindrical housing 2, and for that matter the valve 4 and vented retainer 6, may be preferably formed of high-density polyethylene. However, other plastics such as polypropalene may be employed. It should be noted, however, that high-density polyethylene is preferred because the waxy or candle-like surface thereof assists the sealing function of the embodiment of the non-refillable fitment according to the invention. This sealing function, as shall be readily appreciated by those of ordinary skill in the art, is implemented within the non-refillable fitment according to the instant invention not only between the valve 4 and portions of the hollow cylindrical housing 2, to be described in greater detail below, but also between the outer circumference of the hollow cylindrical housing 2 and the neck portion of a bottle in which the same is inserted.

The hollow cylindrical housing 2 is provided with a plurality of annular ridges 8 which act to accommodate variations in the inside diameter of the neck of the bottle in that upon insertion of the non-refillable fitment, according to the instant invention, each of the annular ridges 8 will squeeze down to a degree to accommodate the actual interior diameter of the neck of the bottle at the point of insertion. This insures a tight, frictional fit as well as a sealing relationship between the outer surface of the hollow cylindrical housing 2 and the interior of the neck of a bottle. The interior diameter of the hollow cylindrical housing 2 may take any convenient size to accommodate the valve 4 and the vented retainer 6, as well as the wall thickness selected for the housing 2. Typically, five-eighths of an inch or the like is suitable.

The lower interior portion of the hollow cylindrical housing 2 is provided with an annular, aslantly disposed valve seat portion 10 and a conical valve seat 12 is mounted at the base or lower portion of the hollow cylindrical housing 2. The conical valve seat 12 is mounted to the hollow cylindrical housing 2 by a plurality of ribs, not shown due to the section taken, made of the same material as the hollow cylindrical housing 2 and the conical valve seat 12. Thus disposed, the conical valve seat 12 provides a plurality of circumferentially disposed apertures 14 about the base of the hollow cylindrical housing 2, the number of circumferentially disposed aperature portions corresponding to the ribs employed to mount the conical valve seat 12 to the hollow cylindrical housing 2.

The conical valve seat 12 is also provided with an aslantly disposed circumferential portion 16 opposite the aslantly disposed valve seat portion 10 in such manner that the same spatially cooperate with the inner and outer diameter circumferential portions of the valve 4. The conical valve seat 12 is also provided with a centering member 18 which may assist in the centering of the valve 4.

The valve 4 may take the form of an annular ring, as illustrated in FIG. 1, and is formed of the same material as the hollow cylindrical housing 2 although a differing material therefor may be selected to assist in the sealing function or to better accommodate the liquid which is poured therethrough. The outer and inner diameter of the valve 4 will be selected, as will be appreciated by those of ordinary skill in the art, by the inner diameter of the hollow cylindrical housing 2 and the diameter of the conical valve seat 12. These dimensions should be selected so that the valve 4 is freely displaceable within the hollow cylindrical housing 2 while forming a tight seal between the aslantly disposed valve seat portion 10 of the hollow cylindrical housing 2 and the aslantly disposed circumferential portion 16 of the conical valve seat 12.

Typically, the valve 4 may have an outer diameter of nine-sixteenths of an inch and an inner diameter of a quarter of an inch, as measured at the top portion of the valve 4. Both the outer and inner circumferences of the valve 4 are aslantly disposed, in the manner illustrated in FIG. 1, at an angle corresponding to the angle of the aslantly disposed valve seat portion 10 and the aslantly disposed circumferential portion 16 of the conical valve seat 12. Typically, the angle selected will be 15 degrees from the vertical or more, it being noted that in actuality any angle larger than that of a locking taper, i.e. 7 degrees or less, may be employed. Thus, both the circumferential surface 20 associated with the inner diameter of the valve 4 and the outer circumferential surface 22 of the valve 4 may be aslantly disposed at an angle 15 degrees from the vertical.

The vented retainer 6, as illustrated in FIG. 1, may take the form of a hollow annular ring 22 having a circumferential flange 26 and a basket-like venting structure 28 formed by a plurality of extending rib structures 30 connecting the annular ring to a solid bottom portion 32. In this manner once the non-refillable fitment, according to the instant invention, is assembled, full venting and pouring may occur through each of the venting aperatures 34 formed in the vented retainer 6 and the hollow central portion thereof. Access to the valve 4 is foreclosed both by the solid bottom portion 32 and the inward displacement of the aperatures due to the thickness and shape of the annular ring 24 and the ribs 30. This configuration prevents access with a pin or the like through the venting aperatures 34 to the aslantly disposed surface 22 of the valve and the correspondingly aslantly disposed valve seat portion 10. The seal formed between the interior circumferental surface 20 of the valve 4 and the aslantly disposed circumferential portion 16 of the conical valve seat 12 will, of course, be foreclosed by the solid bottom 32 of the vented retainer 6.

When the non-refillable fitment illustrated in FIG. 1 is assembled, the valve 4 is dropped in the hollow cylindrical housing 2. Due to its engagement with the interior sidewalls of the hollow cylindrical housing 2, the valve will drop around conical valve seat 12 so that its interior disposed surface 20 will engage the aslantly disposed circumferential portion 16 of the conical valve seat 12. Similarly, its outer aslantly disposed surface 22 will engage the aslantly disposed valve seat portion 10 on the hollow cylindrical housing 2. Thereafter, the vented retainer portion 6 is inserted within the hollow cylindrical housing 2 until the circumferential shoulder 26 engages the walls of the hollow cylindrical housing 2. When this is done, the vented retainer 6 may be sonically welded in place, or alternatively, a few drops of adhesive may be applied thereto prior to insertion so that the same is permanently mounted within the hollow cylindrical housing 2.

Upon completion of the assembly, the vented retainer 6 may not be removed with a pin or hook-like member engaging the venting aperatures 34 without seriously damaging and deforming the non-refillable fitment to such a degree that attempted tempering will be apparent to a user prior to use. Once the non-refillable fitment is assembled and sealed, those of ordinary skill in the art will appreciate that the same resembles a cork and is preferably shipped to bottlers and the like in this form so the same may be inserted during the bottling process. Insertion during the bottling process requires only an added stage be provided for the bottling line wherein the cork-like configuration of the non-refillable fitment, according to the instant invention, is automatically fed to a station on the bottling line where it is inserted in the neck of the bottle after the same has been filled and depressed into the neck by a piston or the like until the same is at or slightly below the top of the neck. Thereafter, the bottle may be capped in the traditional manner using traditional caps.

While the vented retainer 6, illustrated in FIG. 1, has been shown as taking the form of a hollow retainer having a basket-like venting structure, those of ordinary skill in the art will appreciate that instead the same could comprise a solid member having venting aperatures completely therethrough. The depth of the venting retainer 6, as well as the height of the hollow cylindrical housing, are of some import as the same must be sufficient to allow proper venting of the fluid to occur when pouring is taking place and to retain the valve 4 in what is known as a cocked position, i.e. at an angle of approximately 45 degrees. This cocked condition will result, as will be clear upon a description of FIG. 3, due to the displacement between the solid bottom portion 32 of the vented retainer 6 and the lower shoulder 36 of the hollow cylindrical housing 2. This displacement is such that when the valve 4 is displaced upon an inclination of the fitment within a bottle, such as during a pouring condition, the same will assume an inclination of approximately 45 degrees. Thus, while a somewhat greater or lesser angle is suitable, allowing displacement for the valve 4 to rotate through a 90 degree angle could well cause sticking or jamming of the valve 4, while a significantly smaller displacement would not permit liquid to be poured through portions of the circumferentially disposed aperatures 14 while air is permitted to enter through other portions of the venting aperatures 34 and the circumferentially disposed aperatures 14, to achieve a sufficient rate.

Figure 2:
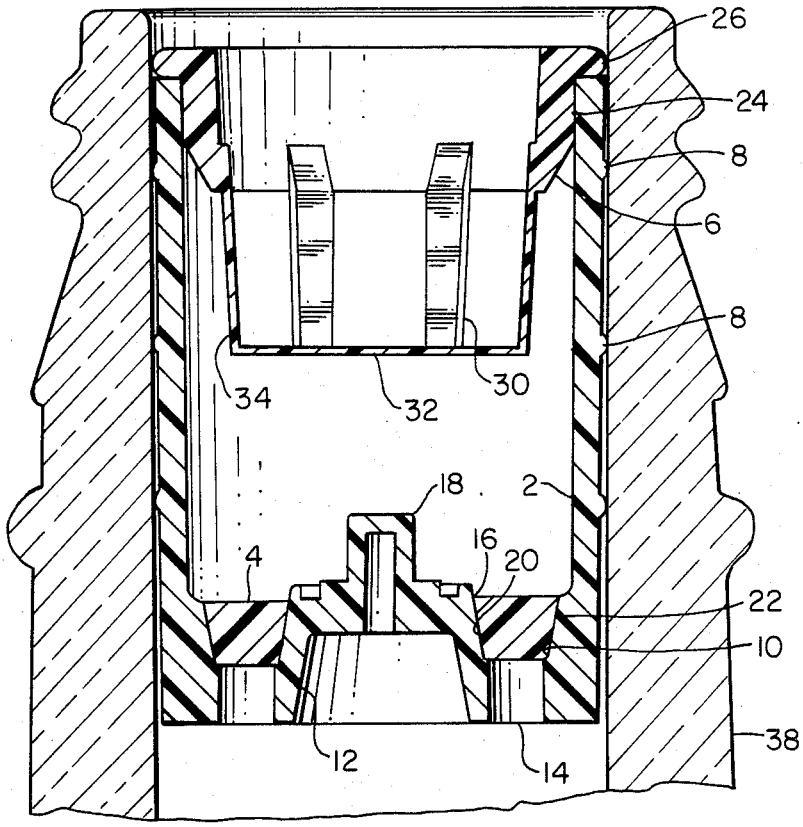
FIG. 2 is a sectional view illustrating the exemplary embodiment of the non-refillable fitment depicted in FIG. 1, assembled and within the neck of a vertically disposed conventional bottle.

Referring now to FIG. 2, there is shown a sectional view illustrating the embodiment of the non-refillable fitment depicted in FIG. 1 assembled and within the neck of a vertically disposed conventional bottle. In FIG. 2 and in FIG. 3, a portion of the neck of the bottle shown has been designated by reference numeral 38 while the remaining portions of the assembled non-refillable fitment have been annotated with reference numerals corresponding to those employed in FIG. 1. Further, to avoid undue repetition, the description of subject matter already described in connection with FIG. 1 shall not be reiterated.

When the bottle 38 illustrated in FIG. 2 is in an upright position, the valve 4 in the form of an annular ring will be disposed about the conical valve seat 12 so that an annular seal is formed between the aslantly disposed surfaces 20 and 22 of the valve and the aslantly disposed valve seat portion 10 of the hollow cylindrical housing 2 and the aslantly disposed circumferential portion 16 of the conical valve seat 12. With such an annular sealing relationship, those of ordinary skill in the art will recognize that the valve 4 is self-centering and, in fact, any attempt to refill the bottle via pouring in liquid from the open end of the bottle through the vented retainer 6 will result in an increase of the sealing pressure associated with the valve 4. Similarly, should filling of the bottle through jiggling or the rapid upward and downward displacement of the bottle occur, the self-centering valve 4 will still be retained in its position by any liquid flow introduced in from the open end of the bottle to prevent unauthorized refilling. This will also occur where the bottle is tilted or the like since in actuality the valve 4 will not normally displace until a pouring inclination of the bottle reaches 90 degrees except under such conditions when the bottle is very full and where less of an inclination forces liquid from the bottle against the bottom of the valve.

Those of ordinary skill in the art will also appreciate that with the fitment inserted, the plurality of annular ridges 8 effectively deform to configure themselves to the actual dimensions of the bottle. The ridges 8 thus act in much the same manner as O rings and of course form a tight, frictional fit to maintain the fitment within the bottle and avoid tampering without deformation of the fitment. It will also be noted that the entire fitment assembly is wholly within the neck of the bottle so that tampering in all places but the open top of the bottle is avoided. Access from the open top to the seated valve 4 is also prevented under these conditions by the closed bottom portion 32 of the vented retainer ring and the inward displacement of the venting aperatures 34 therein so that access to the seated valve 4 at either its outer or inner sealing surfaces 20 or 22 is prevented.

Figure 3:
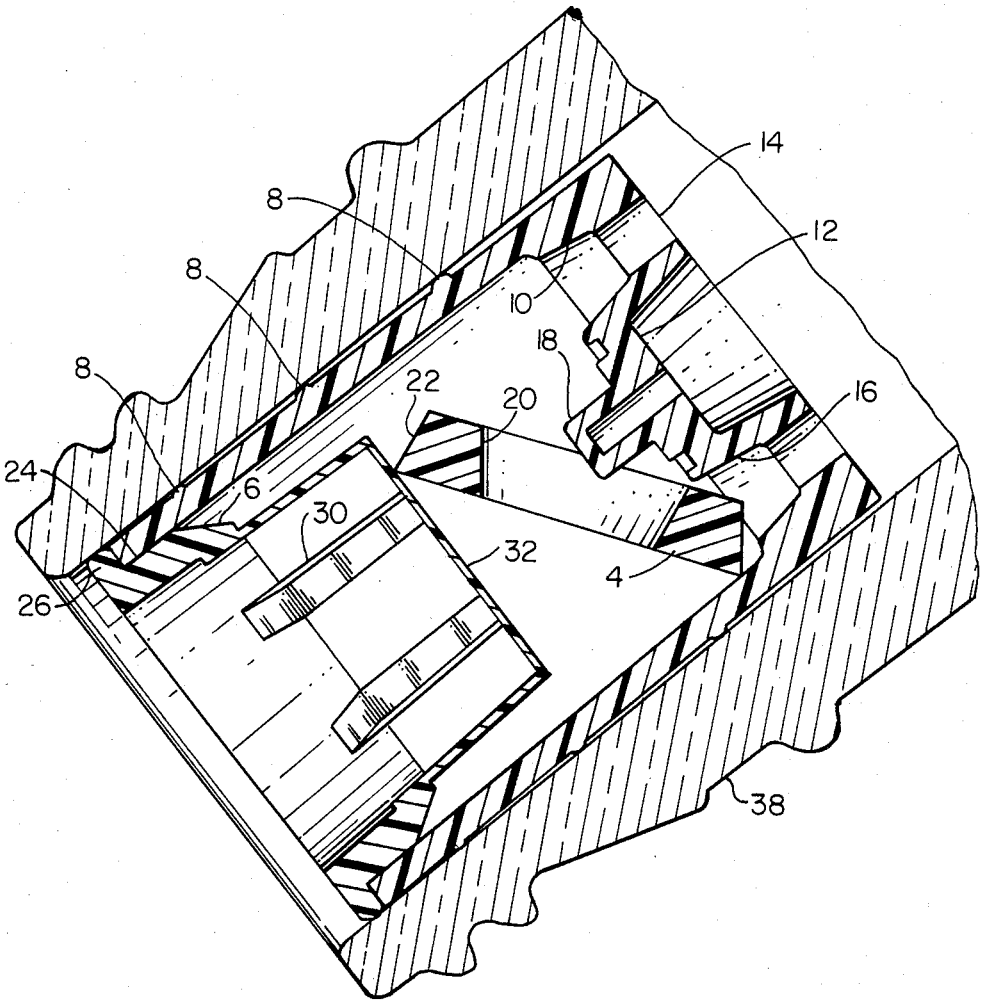
FIG. 3 is a sectional view showing the embodiment of the non-refillable fitment shown in FIG. 1 assembled and within the neck of a conventional bottle inclined at an angle for pouring.

A sectional view which illustrates the embodiment of the non-refillable fitment according to this invention is depicted in FIG. 3 assembled and within the neck of a conventional bottle and inclined at an angle for pouring. Because the non-refillable fitment, according to the instant invention, seals, as aforesaid, on two angular non-locking surfaces as defined by the aslantly disposed surfaces 20 and 22 on valve 4 and aslantly disposed valve seat surfaces 10 and 16, the valve 4 will not typically displace from its sealed position, as shown in FIG. 2, until the bottle in which the fitment is mounted exceeds a pouring angle of approximately 90 degrees. This, of course, assumes that an average value of liquid is in the bottle since when the same is very full, pressure of the liquid within the bottle through circumferentially disposed aperatures 14 at a lesser angle will cause valve 4 to displace.

Similarly, when the bottle tends to be substantially less than half full, the valve 4 may not displace until a pouring angle of 135 angles is reached. The taper fit established by the aslantly disposed surfaces 20 and 22 on the washer and the correspondingly aslantly disposed valve seat surfaces 10 and 16 are also advantageous since they provide a self-alignment mechanism within the non-refillable fitment so that the valve 4 always falls into its proper location and seats itself through the action of gravity when the bottle is placed in the upright position, as shown in FIG. 2. In fact, this self-aligning feature is so positively acting that the centering member 18 on the conical valve seat 12 need not be employed in all embodiments of the invention, and this is particularly so when the hollow cylindrical housing 2 is configured so as to provide little room for the valve 4 to displace in a side-to-side manner when the same is not seated.

When the bottle is inclined at a pouring angle, as illustrated in FIG. 3, the valve 4 will typically assume the cocked position illustrated in FIG. 3 which is approximately 45 degrees with respect to the center axis of the hollow cylindrical housing 2. However, since the distance between the bottom portion of the hollow cylindrical housing 2 and the solid bottom portion 32 of the vented retainer 6 is less than the diameter of the valve, the valve 4 may not assume a position wherein it is capable of being locked in an open condition. Hence, when the bottle is inclined in the manner illustrated in FIG. 3, the valve 4 will assume the cocked position shown. Under these conditions fluid from the interior portion of the bottle will be provided through portions of the circumferentially disposed aperatures 14 which happen to be located toward the bottom of the valve when the bottle is inclined, while air from the vented retainer 6 is provided through the upper portions of the circumferentially disposed aperatures 14 to vent the contents of the bottle and allow pouring to progress at an appropriate rate. It should be noted that while the dimensions set forth herein are merely exemplary, marked reductions in the distance between the bottom portion of the hollow cylindrical housing 2 and the solid bottom portion 32 of the vented retainer 6 due to either a decrease in the height of the hollow cylindrical housing or an increase in the depth of the vented retainer member 6 will substantially reduce the pouring rate. A similar result also obtains if the diameter of the hollow cylindrical housing 2 and the valve 4 are substantially increased. Those of ordinary skill in the art will also appreciate that the provision of a minor molding post (not shown) or a plurality of the same on the upper surface of the valve 4 will further increase the ability of the same to remain in a cocked condition without locking or sticking under any pouring circumstance.

When the bottle is returned from the inclined condition for pouring illustrated in FIG. 3 to its vertical condition, as illustrated in FIG. 2, the valve 4 will return through the action of gravity to its sealing condition, as illustrated in FIG. 2. Because a seal is achieved on two angular non-locking surfaces on valve 4, the taper fit is self-aligning and the valve 4 will always fall into its proper position through the action of gravity. This avoids any need or requirement to achieve a horizontal seal, and the action of the taper fit also guides the valve to a properly sealed relationship. Thus, gravity alone puts the valve 4 into the proper position due to its angular geometry on both its inner and outer diameter surfaces 20 and 22.

The non-refillable fitment, once assembled in the manner illustrated in FIGS. 2 and 3, closely resembles a conventional bottle cork as far as its overall size and configuration are concerned, and hence, the same would be employed by bottlers in a bottling operation in precisely the same manner as a cork. Thus, in the bottling operation the same need only be mechanically inserted within the neck of a bottle, as shown in FIGS. 2 and 3, subsequent to the step of filling the bottle. Thereafter a normal capping procedure using standard caps for the standard bottles selected would be initiated. Therefore, the invention results in an inexpensive, efficient non-refillable configuration which may be readily added to conventional bottling lines without any requirement for a major modification in the line.

Those of ordinary skill in the art will appreciate that each element of the basic three-part assembly of the exemplary non-refillable fitment illustrated in FIG. 1 is quite simple in geometry, thus readily lending the elements to molding through high-speed injection techniques or the like. This in turn insures that the cork-like assembly can be manufactured at extremely low cost. Furthermore, since the fitment resembles a cork-like structure sized to fit standard bottle neck sizes, the same may be inserted by conventional techniques in a standard bottling operation while use of standardized bottles and caps is retained. In addition, since annular sealing rather than bottom sealing is employed, clog-free operation is insured in all situations except where the liquid being poured has a high sugar content or otherwise contains particulate matter which would substantially interfere with the operation of the valve.

Sticking or jamming of the valve 4 is also avoided due to the relatively free-wheeling operation thereof within a volume which is specifically confined to prevent the valve 4 from assuming any position except from that on the conical valve seat 12 which is stable when the fitment is vertically disposed. Furthermore, since the fitment assembly process as well as the insertion of the fitment into a bottle is purely mechanical, inexpensive integration into a bottling line or the like is assured. The resulting installed non-refillable fitment, it should be noted, it also totally internal to the bottle neck making tampering extremely difficult without the same showing clear signs indicative of such tampering. In addition, because only a few sealing surfaces or for that matter interacting surfaces are involved, the resulting non-refillable fitment is highly reliable in operation and generally jam free.

Those of ordinary skill in the art will also appreciate that while the disclosure of the instant invention has made repeated reference by way of example to liquor industry applications and problems, these same problems and applications are fully applicable to liquid containers employed by the drug, food, cosmetic, perfumery or any other industry wherein liquids subject to counterfeiting, adulteration or tampering are sold in bottled form to the public.

Although the instant invention has been disclosed in conjunction with a preferred embodiment which is viewed as both positively acting and inexpensive to manufacture, various modifications and alterations in the features of the embodiment described herein will occur to those of ordinary skill in the art. This is particularly so when other applications for the instant invention are considered. Thus, the vented retainer 6 may be configured in solid form with venting aperatures provided therethrough, and in certain applications the circumferential shoulder 26 may be entirely replaced with a drip-proof top or the like. In like manner, while seating of valve 4 has been shown as provided between valve seat 12 and a slantly disposed valve seat surface 10, surfaces 10 and 16 may both be considered and configured as a single valve seat. Similarly, various other forms of changes in overall configuration will represent a design choice when differing bottle neck standards or specific shapes of bottles are considered.

Thus, although the instant invention has been described in connection with a highly specific exemplary embodiment thereof, it will be understood that many modifications and variations thereof will be readily apparent to those of ordinary skill in the art. Therefore, it is manifestly intended that this invention be only limited by the claims and equivalents thereof.

What is claimed is:

1. A non-refillable fitment comprising:

a hollow cylindrical housing configured to be inserted into the neck of a bottle;

an insert member disposed within said hollow cylindrical housing, said insert member having an inner circumferential surface and an outer circumferential surface defining an annular valve seat providing a flow path through said housing;

retainer means disposed within said hollow cylindrical housing longitudinally displaced predetermined distance from said insert member, said retainer means including vent means for permitting a fluid to flow through said retainer means; and valve means comprising a freely movable annular ring having an inner circumferential surface defining an open central region and an outer circumferential surface, said valve means being retained within said hollow cylindrical housing between said insert member and said retainer means, said valve means having a configuration adapted to enter said annular valve seat when said hollow cylindrical housing is vertically disposed, whereby said inner circumferential surface of said valve means sealingly engages said inner circumferential surface of said insert member and said outer circumferential surface of said valve means sealingly engages said outer circumferential surface of said insert member to thereby prevent fluid from flowing through said fitment into said bottle, said predetermined distance between said retainer means and said insert member being less than the diameter of said outer circumferential surface of said valve means whereby when said hollow cylindrical housing is aslantly disposed in a pouring position, said valve means can drop out of said valve seat and be disposed angularly between said retainer means and said insert member without inverting so as to permit said fluid to flow out of said bottle through said open central region of said valve means and said fitment.

2. The non-refillable fitment of claim 1 wherein the outer surface of said hollow cylindrical housing includes a plurality of annular ridges for establishing a tight frictional fit between said housing and said neck of said bottle.

3. The non-refillable fitment of claim 1 wherein each of said inner and outer circumferential surfaces of said valve seat and of said valve means is correspondingly angularly disposed with respect to the central axis of said cylindrical housing.

4. The non-refillable fitment of claim 1 wherein said retainer means includes a lower transverse wall portion extending across said hollow cylindrical housing, wherein said valve means is retained between said insert member and said lower transverse wall portion of said retainer means.

5. The non-refillable fitment of claim 4 wherein said retainer means has a generally cylindrical configuration defined by a cylindrical wall portion terminating in said lower transverse wall portion.

6. The non-refillable fitment of claim 4 wherein said vent means comprises a plurality of apertures in said cylindrical wall portion of said retainer means.

7. The non-refillable fitment of claim 1 wherein said hollow cylindrical housing and said insert member comprise a unitary member.

8. The non-refillable fitment of claim 1 wherein said insert member includes a centering post member centrally disposed with respect to said annular valve seat to assist in centering said valve means into said annular valve seat.

* * * * *